US010081148B2

(12) United States Patent
Koenig et al.

(10) Patent No.: US 10,081,148 B2
(45) Date of Patent: Sep. 25, 2018

(54) SYSTEM AND METHOD FOR CRUSHING AND COMPACTION

(71) Applicants: Mark E. Koenig, Pickerington, OH (US); Larry E. Koenig, Canal Winchester, OH (US)

(72) Inventors: Mark E. Koenig, Pickerington, OH (US); Larry E. Koenig, Canal Winchester, OH (US)

( * ) Notice: Subject to any disclaimer, the term of this patent is extended or adjusted under 35 U.S.C. 154(b) by 132 days.

(21) Appl. No.: 15/217,668

(22) Filed: Jul. 22, 2016

(65) Prior Publication Data

US 2016/0332404 A1 Nov. 17, 2016

Related U.S. Application Data

(63) Continuation of application No. 13/012,277, filed on Jan. 24, 2011, now Pat. No. 9,403,336, which is a (Continued)

(51) Int. Cl.
*B30B 9/14* (2006.01)
*B30B 9/30* (2006.01)

(52) U.S. Cl.
CPC ..... *B30B 9/3089* (2013.01); *B30B 9/3014* (2013.01); *B30B 9/3042* (2013.01); *B30B 9/3082* (2013.01)

(58) Field of Classification Search
CPC ..... A21C 1/065; B30B 9/121; B30B 9/12; B30B 9/3007; B30B 9/321; B30B 9/16; (Continued)

(56) References Cited

U.S. PATENT DOCUMENTS 728,516 A 5/1903 Trabue
829,315 A 8/1906 Anderson
(Continued)

OTHER PUBLICATIONS

FKC Co., Ltd., Biosolids Dewatering, sales literature, 2 pages, found at www.fkcscrewpress.com, copyrighted 2009.
(Continued)

*Primary Examiner* — Anthony Stashick
*Assistant Examiner* — Onekki Jolly
(74) *Attorney, Agent, or Firm* — Stanley Law Group LLP

(57) ABSTRACT

An exemplary embodiment of a screw crusher may utilize a cantilevered screw with an inverse tapered shaft with flighting for conveying the product up the length of the shaft for compression. The screw may include an end flight configured to provide thrust to the product for further conveyance beyond the end of the screw or additional compaction when utilized with a receiving container. An exemplary embodiment of the screw crusher may utilize a single moving element in relation to a cylindrical tube for compression of the product. Also, an exemplary screw compactor may utilize a fixed replaceable restrictor tube section and an efficient screw design making it more cost effective and efficient to operate than other known compactors. Furthermore, an example of the screw crusher may be fitted with perforated or the preferred "V" Slotted tube to perform liquid removal in addition to the compaction of the material.

38 Claims, 8 Drawing Sheets

Related U.S. Application Data continuation-in-part of application No. 13/007,864, filed on Jan. 17, 2011, now Pat. No. 8,708,266.

(60) Provisional application No. 61/421,505, filed on Dec. 9, 2010.

(58) Field of Classification Search
CPC ... B30B 9/3082; B30B 9/3089; B30B 9/3042; B30B 9/3014; D21C 9/18; B02C 19/10; B02C 2/10; B01F 7/00816
USPC ..... 100/117, 145, 146; 241/203, 260, 260.1; 198/550.6, 661
See application file for complete search history.

(56) References Cited

U.S. PATENT DOCUMENTS 1,221,054 A 4/1917 Hyatt
1,506,036 A 8/1924 Willmarth
2,411,971 A * 12/1946 MacMillin ..... B29C 47/92 100/145
2,470,278 A 5/1949 West
2,576,784 A 11/1951 Galen
2,615,387 A 10/1952 Messing
2,823,603 A 2/1958 Collins
2,902,922 A 9/1959 Williams
2,982,201 A 5/1961 Raymond
3,179,040 A 4/1965 Seltzer
3,376,910 A 4/1968 Popeil
3,588,356 A 6/1971 Poux et al.
3,787,830 A 1/1974 Cato
3,866,529 A 2/1975 Holman
3,877,365 A * 4/1975 Berggren ..... B30B 9/124 100/117
3,938,434 A 2/1976 Cox
3,982,483 A 9/1976 Bird et al.
4,037,528 A 7/1977 White
4,256,035 A * 3/1981 Neufeldt ..... A01F 15/00 100/145
4,289,067 A 9/1981 Hanak
4,323,007 A 4/1982 Hunt et al.
4,355,905 A 10/1982 St. Louis et al.
4,426,922 A * 1/1984 Yamamoto ..... B02B 3/00 241/239
4,516,492 A 5/1985 Olfert
4,636,127 A 1/1987 Olano et al.
4,709,628 A 12/1987 Glowacki
4,747,343 A * 5/1988 St. Clair ..... A01F 25/14 100/145
4,770,236 A 9/1988 Kulikowski
4,807,816 A 2/1989 Ataka
4,852,817 A 8/1989 Tipton
4,897,194 A 1/1990 Olson
4,951,884 A 8/1990 Koenig
5,040,736 A 8/1991 Obitz
5,108,040 A 4/1992 Koenig
5,114,331 A 5/1992 Umehara et al.
5,148,994 A 9/1992 Haider et al.
5,148,998 A 9/1992 Obitz
5,180,225 A 1/1993 Piccolo, Sr. et al.
5,308,003 A 5/1994 Koenig
5,373,923 A 12/1994 Koenig
5,383,397 A 1/1995 Battles
5,601,239 A 2/1997 Smith
5,611,268 A 3/1997 Hamilton
5,662,035 A 9/1997 Lee
5,695,136 A 12/1997 Rohden et al.
5,735,199 A 4/1998 Esau
5,819,643 A 10/1998 Mcilwain
RE36,023 E * 1/1999 Koenig ..... B02C 19/22 100/145
5,873,304 A 2/1999 Ruf
6,247,662 B1 6/2001 Hamilton
6,276,622 B1 8/2001 Obitz
6,505,550 B2 * 1/2003 Hamilton ..... B30B 9/3025 100/148
6,793,165 B2 9/2004 Obitz
6,945,487 B1 9/2005 Obitz
7,011,018 B2 3/2006 Schroeder et al.
7,226,213 B2 6/2007 Roos et al.
7,229,526 B2 6/2007 Obitz
7,234,915 B2 6/2007 Obitz
7,360,639 B2 4/2008 Sprouse et al.
7,523,996 B1 4/2009 Darst
7,631,596 B2 12/2009 Williams
7,740,325 B1 6/2010 Chen
7,828,482 B2 11/2010 Beausoleil et al.
7,851,585 B2 12/2010 Brison et al.
8,033,733 B2 10/2011 Lang
2005/0069446 A1 3/2005 Kriehn
2008/0028952 A1 2/2008 Deperon
2008/0121497 A1 5/2008 Esterson et al.
2009/0183971 A1 7/2009 Basagila et al.
2009/0285765 A1 * 11/2009 Ivanova ..... A61K 8/89 424/47
2010/0266230 A1 10/2010 Hong

OTHER PUBLICATIONS

RUNI Danish Engineering, SK240, sales literature, 1 page, found at www.runi.dk, copyrighted 2009.
RUNI Danish Engineering, Screw Compactor, product information, 2 pages, found at www.compactor-runi.com, Apr. 19, 2011.
Intcorecycling.com, GreenMax Recycling Machine, product information, 1 page, found at www.intcorecycling.com, copyrighted 2009-2010.
Foam Equipment + Consulting Co., Heger Recycling Equipment, sales literature, 3 pages, found at www.foamequipment.com/heger.com, copyrighted 2011.
RecycleTech Corp., RecycleTech—The Environment Savers, company information, 1 page, found at www.recycletechno.com, copyrighted 2009.
Intcorecycling.com, GreenMax Recycling Machine, product information, 2 pages, found at www.intcorecycling.com, copyrighted 2009-2010.
Sebright Products, Inc., Bright Technologies—Innovators in Dewatering Equipment Technologies, product information, 2 pages, found at www.brightbeltpress.com, copyrighted 2006.

* cited by examiner

SYSTEM AND METHOD FOR CRUSHING AND COMPACTION

This application is a continuation of U.S. application Ser. No. 13/012,277, filed Jan. 24, 2011, which is a continuation-in-part of U.S. application Ser. No. 13/007,864, filed Jan. 17, 2011, which claims the benefit of U.S. Provisional Application No. 61/421,505, filed Dec. 9, 2010, each of which is hereby incorporated by reference as if fully recited herein.

BACKGROUND AND SUMMARY OF THE INVENTION

Exemplary embodiments of the invention are related to a crusher with the ability to compact. More particularly, exemplary embodiments may include a screw crusher that may facilitate the movement of compacted or compressed material better than known crushers.

The amount of consumer products being brought to market with disposable packaging and products with a shelf life containing liquids have driven the market need for many different and more efficient methods of processing these products as they enter the waste stream. Furthermore, the amount of materials ending up in landfills is continuously increasing. As the scarcity of landfill space increases, along with more stringent environmental regulations, there have been increased efforts to reduce the amount of waste produced by individuals, in addition to an increased effort to recycle materials. Many different processes and machines have been developed to combat this ever-increasing problem.

The liquid content of waste products creates multiple issues for retailers, landfills, and manufacturers. Liquid delivery to landfills is discouraged by landfills and, in some circumstances, loads with excessive liquids are refused. Waste haulers often charge retailers and manufacturers by the ton for transporting waste. Most liquids are very heavy, increasing disposal cost. Additionally, environmental fines for leaking waste are imposed on haulers trying to transport waste containing liquids. Recyclers desire product that includes minimal amounts of liquid delivered to them as it hinders their automated processing. Liquid is a detriment for waste destined to be utilized as a fuel as the transportation costs are increased and the aggregate BTU value of the material is reduced. Liquid is often the product of the manufacturer. Thus, separating the liquid and disfiguring the packaging reduces liability of the undesired or substandard product reaching the public.

Consumer packaging, such as plastic bottles and aluminum cans, contain large amounts of air when empty. Reducing the volume and increasing density of these products is desirable in order to make transportation and recycling more cost effective. Furthermore, the reduction of volume at the source makes storage requirements significantly more manageable.

Additionally, in certain manufacturing settings when plastic products (for example, large plastic beverage containers) do not meet desired characteristics and/or tolerances, the filled or unfilled beverage containers may need to be recycled. In some scenarios, the liquid containers may already have been at least partially filled with liquid before a device recycles the container. In some situations, a label may need to be removed in addition to or notwithstanding a portion of liquid. Many times these labels may accumulate and back up or hinder the crusher during use.

There are currently five primary technologies utilized for compacting products and separating liquids. An exemplary embodiment of the invention provides increased efficiencies and remedies problems with known technologies, such as: Ram Compaction, Roll Compactors, Heat Extrusion, Screw Compactors with compression flights, and Screw Compactors with a powered adjustable restricting mechanism.

The existing screw compactors are inefficient in function as they utilize a powered restricting device to create back pressure against the material being crushed or extruded in order to flatten the product. The restricting mechanisms of known screw compactors also have some further drawbacks. The restricting mechanisms consume additional power, have multiple moving parts which reduce reliability, and provide constant back pressure that increases wear of the end of the screw assembly. In known screw compactors, the flattening of the product occurs as a result of restricting the flow of the mass of material being extruded. However, known restricting mechanisms commonly allow some full or partially full products, such as bottles, to remain unchanged in form (i.e., not crushed). This makes known technology ineffective for removing liquid. Furthermore, the constant need for back pressure of the extruded plug of material counteracts the compaction capabilities of known technology for continued conveyance or further compaction into a receiving container for densification for transport. The restricting mechanisms of known technologies create a divergence when trying to combine compaction with a liquid removal capability, resulting in a compactor that is impractical and inefficient.

Given the problems that exist with known screw crushers, a crusher that incorporates minimal moving parts, an ability to provide a higher efficiency of product compaction, an ability to provide additional conveyance and compaction after initial compaction utilizing minimal moving parts, and/or energy efficient design is desired.

Exemplary embodiments may include a screw crusher utilizing a cantilevered screw with an inverse tapered shaft with flighting for conveying the product up the length of the shaft for compression and an end flight providing thrust to the product for further conveyance beyond the end of the screw or additional compaction when utilized with a receiving container. An exemplary embodiment of the device may utilize a single moving element in relation to a cylindrical tube for compression of the product. Also, an exemplary screw compactor may utilize a fixed replaceable restrictor tube section and an efficient screw design making it more cost effective and efficient to operate than other known compactors. Furthermore, an example of the device may be fitted with perforated or the preferred "V" Slotted tube to perform liquid removal in addition to the compaction of the material.

Although this application may talk about a crusher that employs the method of screw compaction to compress plastics and other materials, the crusher may be used in other applications other than compaction processes.

Exemplary embodiments of the crusher may allow for substantially continuous use by minimizing or eliminating a buildup of solid material mass that could slow or stop the crusher.

Exemplary embodiments of the crusher may include a material bin that may be adapted to house crushed material for later disposal.

Exemplary embodiments are directed to a crusher and related methods. Certain embodiments of the crushers may be of multiple geometries and sizes that may be used to compress or compact different materials. Unless expressly set forth, it is not intended to limit the invention to compacting particular materials.

In addition to the novel features and advantages mentioned above, other benefits will be readily apparent from the following descriptions of the drawings and exemplary embodiments.

DETAILED DESCRIPTION OF EXEMPLARY EMBODIMENT(S)

As seen in FIGS. 1-5, exemplary embodiments of a crusher 10 that may be adapted to compact plastics or other materials are illustrated. Exemplary embodiments may include a frame 102 with a proximal end 102A and a distal end 102B such that mounting bodies 104 are attached to the frame 102. In other exemplary embodiments, the frame 102 may be adapted to move on different surfaces with the inclusion of wheels, rollers, or other devices that are included with or exclusive of the mounting bodies 104 that would facilitate movement thereof.

Figure 5:
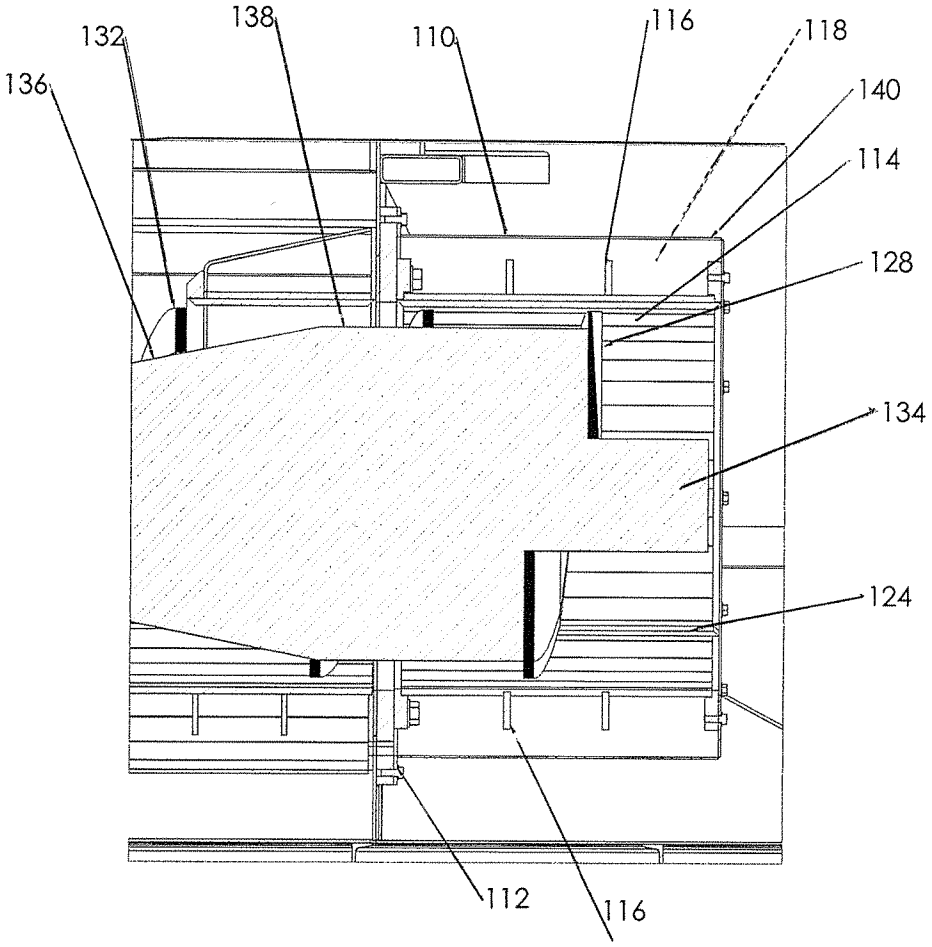
FIG. 5 is a partial cross-sectional view of an exemplary embodiment of a crusher.

Exemplary embodiments of the crusher 10 may include a compaction chamber 110 that may be mounted to the frame 102. The compaction chamber 110 may include one or more mounting bodies 112 that extend from the periphery thereof that facilitate mounting of the compaction chamber 110 with the frame 102. The compaction chamber 110 may be associated with the frame 102 by any number of means. However, in one example, threaded fasteners may facilitate the association. In other exemplary embodiments, the compaction chamber 110 may be freestanding. Also, the compaction chamber 110 may be any number of geometries along its length. In exemplary embodiments, the compaction chamber 110 may be substantially cylindrical along its length. Furthermore, in some exemplary embodiments, the compaction chamber may be comprised of a generally solid shell. However, in some other embodiments, as depicted in at least FIGS. 1, 2, and 5, the compaction chamber 110 may include a series of longitudinal members 114 that are secured at desired positions by one or more securing members 116. The series of longitudinal members 114 and one or more securing members 116 may be associated to allow liquid removal in addition to crushing or compaction of materials. In one example, at least some of the longitudinal members 114 may be fabricated from perforated or substantially "V" or "Y" slotted members to facilitate liquid removal in addition to compaction of the material. The series of longitudinal members 114 and securing members 116 may provide a compaction chamber 110 that may remain substantially the same size as the surface of the compaction chamber 110 wears away through the action of the material therein. Some exemplary embodiments of the compaction chamber 110 may include a series of longitudinal members 114 and securing members 116 that are located within a substantially tubular body 118, as depicted in FIGS. 1 and 5.

The compaction chamber 110 includes an inlet portion 120 (i.e., inlet chamber 120) that is adapted to receive materials and initiate the crushing process of introduced materials. The walls of the compaction chamber 110 may be fabricated from materials that are strong enough to withstand the force exerted by the materials that are compacted or compressed by a screw assembly 130 during use of the crusher 10. One example of the compaction chamber 110 may be substantially cylindrical in geometry, with at least one opening 122 at the distal exit portion of the compaction chamber 110 that allows the compressed or compacted material to exit. In this example, the proximal end of the inlet portion 120 may allow a screw assembly 130 to pass through a proximal wall. In other exemplary embodiments, a screw assembly may be rotatably secured to a proximal portion of the compaction chamber. At least a portion of the top of the inlet chamber 120 may allow material to enter the compaction chamber 110. However, in other embodiments, the inlet chamber 120 may be any number of geometries and positions that allow material to enter the compaction chamber 110. In some examples, the inlet chamber 120 may have multiple openings, such as openings in the top surfaces of the compaction chamber 110, which allow material to enter the compaction chamber 110 for compression and/or compaction (e.g., at generally the same or different points along the length of the compaction chamber 110).

One or more flow bars 124 may be situated within at least a portion of the interior of the compaction chamber 110. The one or more flow bars 124 facilitate the flow of material being compacted within the compaction chamber during use of the crusher by helping push material (in concert with the screw flights) from the inlet portion 120 to an outlet portion 140 (i.e., outlet chamber 140).

Figure 1:
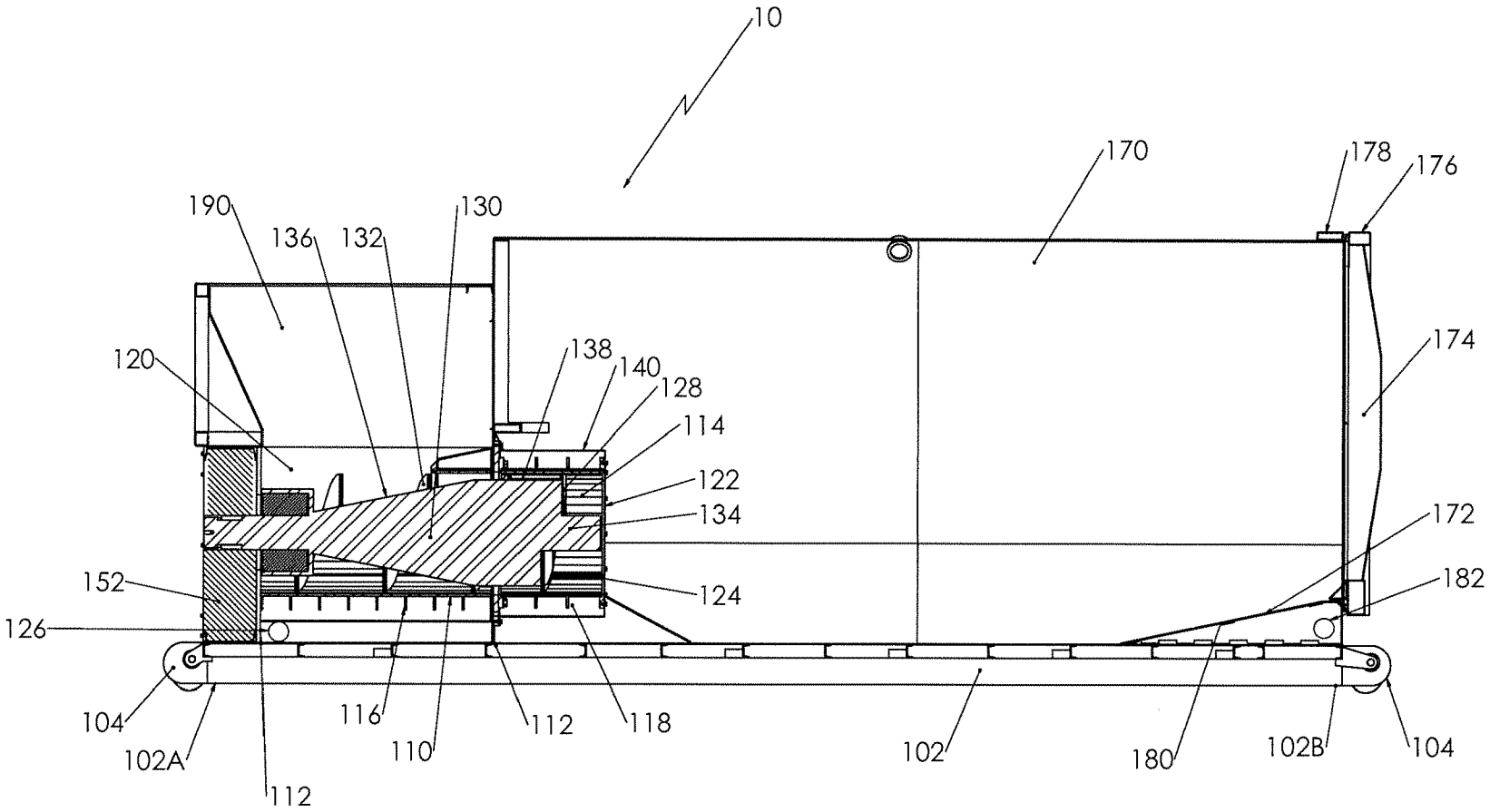
FIG. 1 is a cross-sectional view of an exemplary embodiment of a crusher.
Figure 3:
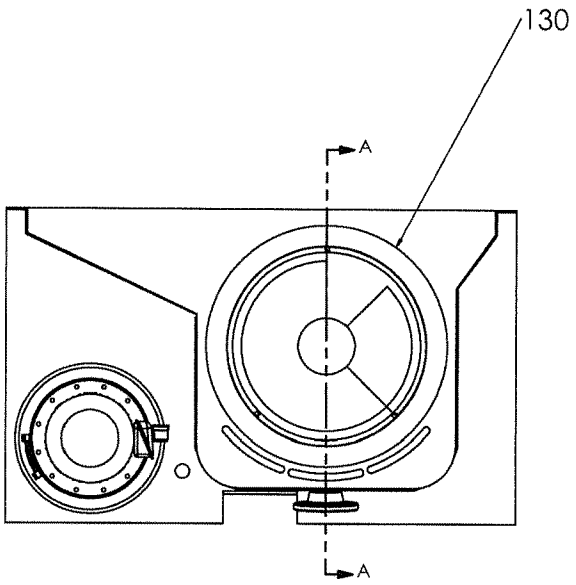
FIG. 3 is a cross-sectional end view of an exemplary embodiment of a crusher.
Figure 2:
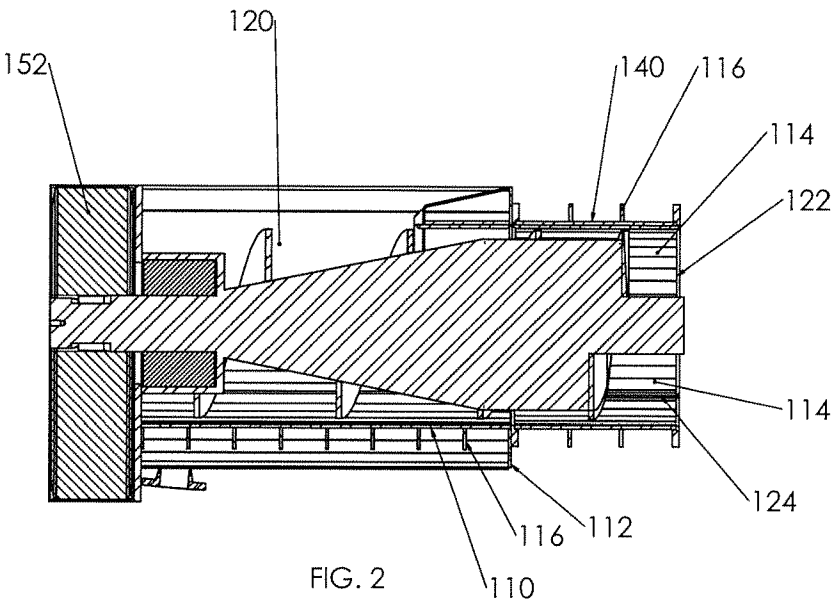
FIG. 2 is a cross-sectional view of an exemplary embodiment of a crusher.

The compaction chamber 110 may include one or more drain apertures or drain connections 126, as depicted in FIG. 1, that facilitate the draining of liquids or other materials from within the compaction chamber 110. In one example, some exemplary embodiments of the crusher 10 may be used to compact or compress full or partially full plastic liquid containers. In this example, during the compaction process liquids contained within the bottles or other containers will empty within the compaction chamber 110 and flow between longitudinal members 114 to drain aperture 126. A drain aperture 126 may facilitate the removal of the unwanted liquids. Exemplary embodiments of drain apertures 126 may allow a drainage hose or other device to be associated with the drainage aperture 126 to facilitate removal of the undesired liquid. Additionally, some exemplary embodiments of the crusher 10 may include drain apertures 126 that facilitate the cleaning or maintenance of the crusher 10.

Exemplary embodiments of the compaction chamber 110 may include wedge wire (not shown) along at least a portion of the interior. The wedge wire may facilitate the compaction and advancement of the materials, along with facilitating the drainage of unwanted liquids from the compacted materials. Exemplary embodiments of the crusher may utilize wedge wire in addition to or exclusive of the longitudinal and securing members.

Exemplary embodiments of the compaction chamber 110 house a screw assembly 130 that may be mounted to or otherwise extend generally between the proximal portion and distal portion of the compaction chamber 110. In exemplary embodiments, the screw assembly 130 may be secured to or otherwise be in association with the compaction chamber 110 and/or frame by at least one bearing. In some embodiments, at least a portion of a bearing housing 152 engages at least a portion of the proximal wall of the compaction chamber 110 that may encircle the opening contained therein to assure that material does not exit the proximal end of the compaction chamber 110. A gasket or similar device may be placed between the bearing housing 152 and the proximal wall of the inlet portion 120 to effectuate a seal. At least one bearing may also be contained in a bearing housing 152 associated with a proximal portion of the compaction chamber. A bearing housing 152 may be any number of geometries depending on the number and types of bearings used. However, in some specific embodiments, the bearing housing is substantially cuboid or cylindrical. In exemplary embodiments, the screw assembly 130 may be associated with only the proximal portion of the compaction chamber, creating a cantilevered screw. In this example, the distal end of the assembly 130 is free-floating. A cantilevered screw assembly may be particularly useful for allowing for a containing means to be associated with the compaction chamber for receiving the crushed material. However, in some embodiments, a screw assembly may not be cantilevered.

In an exemplary embodiment, a screw assembly 130 may substantially be the only moving part during the crushing process. In addition to the benefits of cantilevering, the limited number of moving parts may provide multiple benefits. For example, this may allow for simpler operation. It may also allow for less friction during the compaction process as compared to known crushers, which may result in less wear on the components of the crusher. This may also result in the ability to use a smaller or more efficient motor to power the screw assembly as compared to known crushers.

The screw assembly 130 may include one or more flights 132 in exemplary embodiments. Exemplary embodiments of the screw assembly shaft 134 may include a portion 136 that increases in diameter from the proximal portion to the distal portion of the assembly 130. In exemplary embodiments, the portion of increased diameter 136 may be integral with the rest of the shaft 134. However, in some embodiments, the portion of increased diameter 136 may be associated with the shaft 134 by welding or other methods. In some exemplary embodiments, material may be crushed between the portion of increased diameter 136 and the compaction chamber 110.

Exemplary embodiments of the distal portion of the screw assembly 130 may also include a flattened portion 138 that facilitates the compaction of the materials. In an exemplary embodiment, the material may be crushed between the flattened portion 138 and the compaction chamber 110. As a result, the flattened portion 138 may help ensure that the desired thickness of compacted material is produced by the gap between a portion of the compaction chamber 110 and the screw assembly 130. An additional benefit of the flattened portion 138 is that it may contribute to a simpler operation during the crushing process. The simpler operation may allow for less friction while crushing, which may lessen the wear on the components of the crusher. The reduced friction during the crunching process may further facilitate the use of a smaller or more efficient motor to power the screw assembly as compared to known crushers.

Exemplary embodiments of the screw assembly 130 may include one or more flights 132 along the length thereof. The flights 132 may be integral with the screw assembly in some embodiments, but may be associated with the screw assembly in other embodiments. The flights 132 may be any number of geometries and may or may not be continuous along the entire length of the screw assembly 130. Generally, the flights 132 may be included on the inverse tapered shaft (i.e., reverse tapered shaft). The flights 132 may have the same geometry along the entire length of the screw assembly 130 or may change geometry along the length. In one example, the geometry of the flights 132 may be substantially the same along the length of the screw assembly, except along the portion 136 that increases in diameter. For example, along the portion 136 that increases in diameter, the flight geometry may stay the same, except that the lower portion of the flight may be removed to compensate for the increased diameter along the length of the screw assembly. In other exemplary embodiments, the flight geometry (e.g., height) may remain the same along portion 136, which would necessitate a corresponding increase in the diameter of the compaction chamber 110. Exemplary embodiments of the screw assembly 130 may include a pickup compression flight 128 located toward the distal end thereof. The pickup compression flight 128 may facilitate the removal of the crushed material from the outlet portion 140 of the compaction chamber 110. Furthermore, the pickup flight 128 in association with the rest of the screw assembly 130 allows for the compaction of material up the length of the shaft and for providing thrust to the product for further conveyance beyond the end of the screw assembly or additional compaction when utilized with a receiving container. The pickup compression flight 128 may be substantially the same size and geometry of the other flights 132, or may be a different size and geometry than the other flights.

Figure 4:
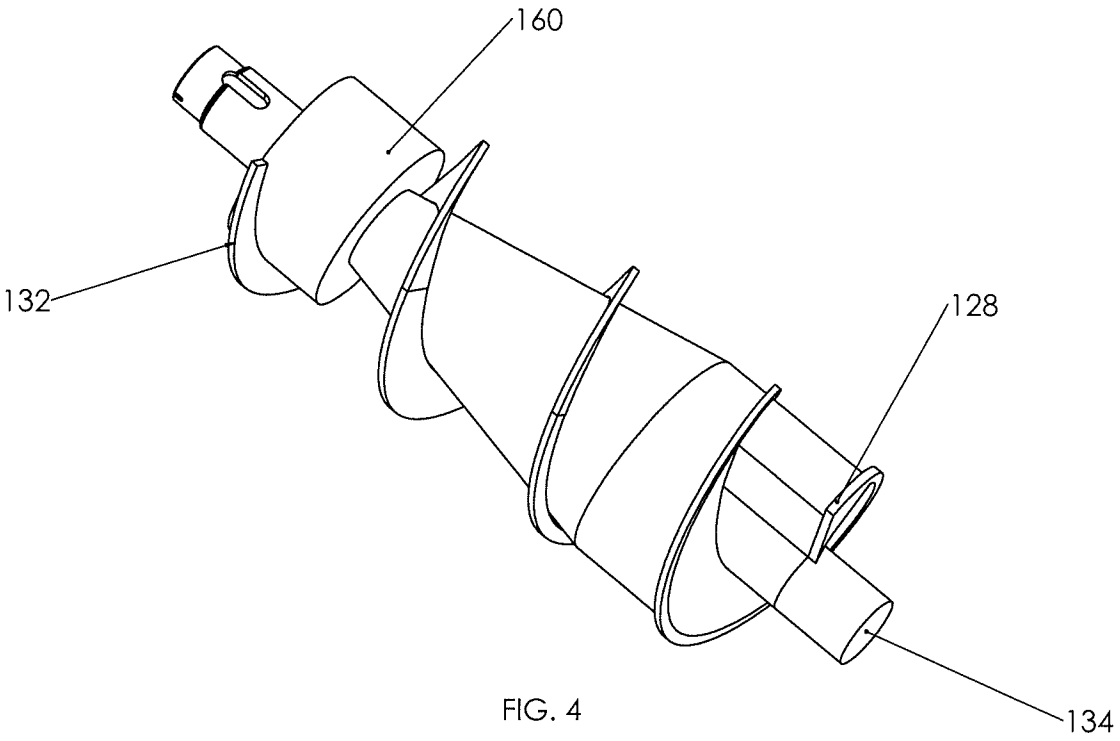
FIG. 4 is a perspective view of an exemplary embodiment of a screw assembly of an exemplary crusher.

Exemplary embodiments of the screw assembly 130 may include a metering member 160, such as a metering bar or metering tube along at least a portion of the length thereof, as depicted in at least FIG. 4. In some embodiments, the metering member 160 may be integral with at least a portion of the screw assembly 130. However, in other embodiments, the metering member 160 may be removably attached to the screw assembly 130. In some exemplary embodiments, the metering member 160 may be associated with the proximal end portion of the screw assembly 130. The metering member 160 may be varying diameters or thicknesses, depending upon the desired size (e.g., thickness) of the material being compacted during use of the compacter. Furthermore, by increasing or decreasing the size of the metering member, both in terms of length and/or diameter, regulation and metering of the volume of material in the processing chamber may be better controlled.

Exemplary embodiments of the compaction chamber 110 may include an outlet portion 140 located at the distal portion thereof that is configured to facilitate the removal of compacted material. The walls of the outlet portion 140 may be fabricated from materials that are strong enough to withstand the force exerted by the materials that are compacted by the screw assembly 130 during use of the crusher 10. One example of the outlet portion 140 may be substantially cylindrical in geometry, with at least one opening at the proximal end of the outlet portion 140 that allows the compressed material to enter. In this example, the proximal end of the outlet portion 140 may allow the screw assembly 130 to pass through, as well as allow the crushed material to enter the outlet portion 140. However, in other embodiments, the outlet portion 140 may be any number of geometries that allow suitable reception of the crushed material to occur. In this example, the outlet portion 140 may have at least one additional opening, such as an opening in the side (e.g., as shown in at least FIG. 1), bottom, or other suitable surface, which allows compacted material to exit the compaction chamber 110.

Exemplary embodiments of the crusher 10 may include a crushed material bin 170 that is adapted to receive and hold material that has been crushed and exited the compaction chamber 110. Exemplary embodiments of the crushed material bin 170 may be associated with the frame 102 and/or compaction chamber 110, such as depicted in FIG. 1, for example. In this particular embodiment, the material bin 170 is associated with the frame 102 from the outlet portion 140 of the compaction chamber 110 outward. However, in other exemplary embodiments, the material bin 170 may be located at different locations on the frame 102 and/or compaction chamber 110, depending upon design characteristics and other needs. Furthermore, in some embodiments, the material bin 170 may not be located on the frame 102. For example, the material bin 170 may be removably attachable to the compaction chamber 110 and/or infeed hopper 190. The material bin 170 may have a number of different geometries that allow suitable operation of the crusher 10. In one example, the material bin 170 is substantially cuboid. Also, in some exemplary embodiments, at least a portion of the bottom inner surface of the material bin may be concave or slanted 172 to facilitate collection of the crushed material at a certain point within the material bin. Furthermore, exemplary embodiments of the material bin 170 may include a screening device or include a slotted portion 180 that is associated with one or more drainage apertures 182 that may facilitate the drainage of fluids from the crushed material to remove any undesired fluid, debris, or particulates that may enter the material bin during use. Exemplary embodiments of drain apertures 182 may allow a drainage hose or other device to be associated with the drainage aperture 182 to facilitate removal of the undesired liquid. For instance, in one exemplary embodiment, the compaction chamber 110 may allow for removal of a major proportion of the undesired liquid, and the material bin 170 may allow for removal of a minor proportion of the undesired liquid. However, other ratios of liquid removal (if applicable) are possible. Additionally, some exemplary embodiments of the material bin 170 may include drain apertures 182 that facilitate the cleaning or maintenance of the material bin 170.

In exemplary embodiments, the crushed material bin 170 may facilitate the crushing of material by providing back pressure against the crushed material exiting the compaction chamber during use. When crushed material accumulates within the bin 170, an exemplary embodiment of a crusher 10 may overcome the force of the piled and crushed material when providing additional crushed material within the interior of the bin. As more and more material accumulates, the greater the back pressure provided by the crushed material in the bin 170 to material that is exiting the compaction chamber 110. As such, in an exemplary embodiment, the material that exits the compaction chamber 110 of the crusher 10 may sustain a desired level of compaction or actually be compacted even further. This may lead to circumstances where baling or other additional procedures are not required, greatly reducing the recycling costs to recyclers. Furthermore, this produces a scenario wherein a restriction mechanism may not be required to obtain desired compaction of materials unlike known compactors.

With reference to FIG. 1, at least a portion of a sidewall of the material bin 170 may be movably attached (e.g., pivotally, hingedly, slidably, removeably, or any other suitable type of moveable attachment) thereto to allow access to the crushed material contained therein. In one example, at least a portion of the distal sidewall 174 may be hingedly attached to another portion of the material bin 170, where a hinge 176 secures one side of the sidewall portion 174 with the material bin 170, and a pin 178 or other securing device releasably secures another side of sidewall portion 174 with the material bin 170. Although the previous example uses a hinge to releasably secure a side wall to the material bin 170, other exemplary embodiments may use other securing means (e.g., locks, clamps, screws, etc.) to effectuate a releasable securement. To help prevent material loss, a gasket or similar device (not shown) may be positioned between the engaged portions. In other embodiments, other types of apparatus that allow for access to the material housed within the bin are appreciated.

Figure 6:
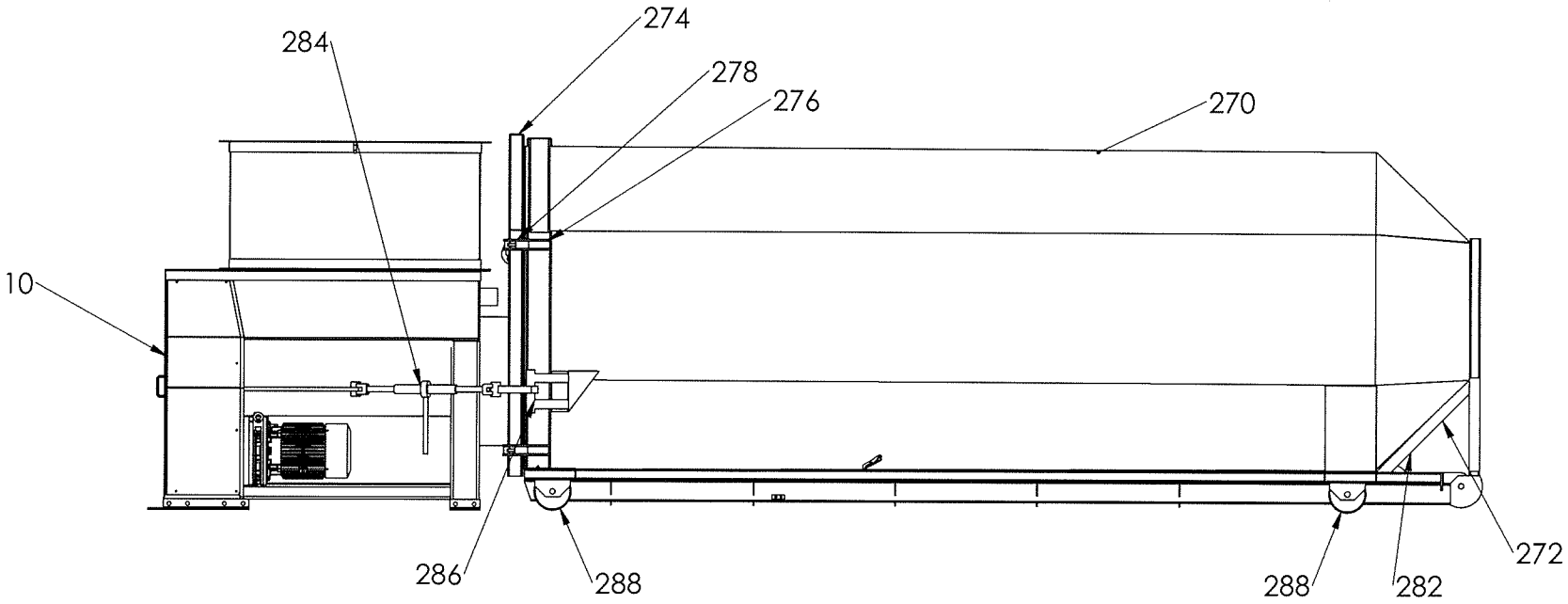
FIG. 6 is an elevated view of an exemplary embodiment of a crusher associated with a detachable material bin.

In other exemplary embodiments, the crusher 10 may be a stand-alone unit that may be removably attached to an exemplary crushed material bin 270, such as depicted in FIG. 6, for example. The material bin may include a frame. In this example, the crushed material bin 270 may include a removable attachment device 284 that facilitates the removable attachment of the crushed material bin 270 with the crusher 10. In one example, the removable attachment device 284 may be a ratchet binder that may be associated with a portion of the crusher 10 and a portion of the bin 270. In this embodiment, the bin 270 and/or crusher 10 may include one or more attachment bodies 286 that facilitate the utilization of the ratchet binder or equivalent device. Other types of devices that facilitate the removable attachment of the crusher 10 to a bin 270 may be used. The removable bin 270 may be adapted to move on different surfaces with the inclusion of wheels or other devices 288 that would facilitate movement thereof.

The material bin 270 may have a number of different geometries that allow suitable operation of the crusher 10. In one example, the material bin 270 is substantially cuboid. Also, in some exemplary embodiments, at least a portion of the bottom inner surface of the material bin may be concave or slanted 272 to facilitate collection of the crushed material at a certain point within the material bin. Furthermore, exemplary embodiments of the material bin 270 may include a screening device or include a slotted portion that is associated with one or more drainage apertures 282 that may facilitate the drainage of fluids from the crushed material to remove any undesired fluid, debris, or particulates that may enter the material bin during use. Exemplary embodiments of a drain aperture 282 may allow a drainage hose or other device to be associated with the drainage aperture 282 to facilitate removal of the undesired liquid. Additionally, some exemplary embodiments of the material bin 270 may include drain apertures 282 that facilitate the cleaning or maintenance of the material bin 270.

With reference to FIG. 6, at least a portion of a sidewall of the material bin 270 may be movably attached (e.g., pivotally, hingedly, slidably, removably, or any other suitable type of moveable attachment) thereto to allow access to the crushed material contained therein. In one example, at least a portion of the sidewall 274 may be hingedly attached to another portion of the material bin 270, where a hinge 276 secures one side of the sidewall portion 274 with the material bin 270, and a pin 278 or other securing device releasably secures the sidewall portion 274 with the material bin 270. Although the previous example uses a hinge to releasably secure the side wall to the material bin 270, other exemplary embodiments may use other securing means (e.g., locks, clamps, screws, etc.) to effectuate a releasable securement. To help prevent material loss, a gasket or similar device (not shown) may be positioned between the engaged portions. In other embodiments, other types of apparatus that allow for access to the material housed within the bin are appreciated.

In exemplary embodiments, the crushed material bin 270 may facilitate the crushing of material by providing a back pressure against material exiting the compaction chamber during use. When crushed material accumulates within the bin 270, an exemplary embodiment of the crusher 10 may overcome the force of the piled and crushed material when providing additional crushed material within the interior of the bin. As more and more material accumulates within the bin 270, the greater the back pressure provided by the crushed material in the bin 270 to material that is exiting the compaction chamber. As such, in an exemplary embodiment, the material that exits the compaction chamber 110 of the crusher 10 may sustain a desired level of compaction or actually be compacted even further. This may lead to circumstances where baling or other additional procedures are not required, greatly reducing the recycling costs to recyclers. Furthermore, this produces a scenario wherein a restriction mechanism may not be required to obtain desired compaction of materials unlike known compactors.

Figure 7:
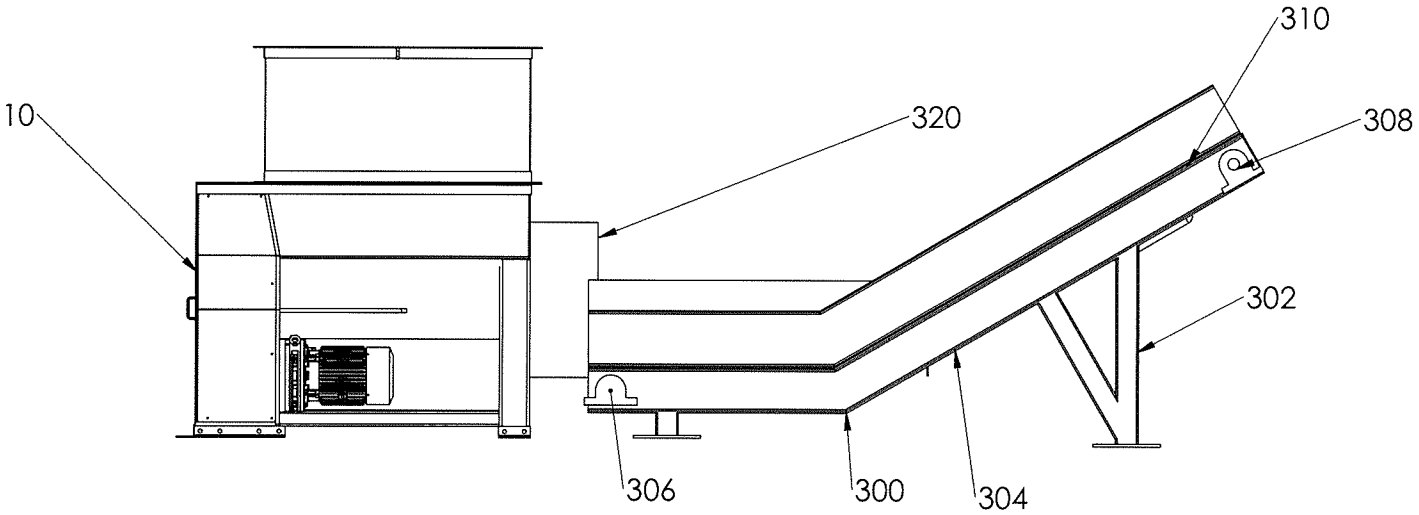
FIG. 7 is an elevated view of an exemplary embodiment of a crusher associated with a discharge conveyor.

In another exemplary embodiment, as depicted in FIG. 7, a stand-alone crusher 10 may be associated with a discharge conveyor 300 by an extrusion body 320. The extrusion body 320 may have any number of cross-sectional geometries, but may be substantially circular in one example. The extrusion body 320 is associated with the distal portion of the compaction chamber 110 to facilitate the removal of the crushed material from therein. The extrusion body 320 may be integral with or associated with the crusher 10.

Exemplary embodiments of the discharge conveyor 300 may include a frame 302, a conveyor body 304, a conveyor motor 306, one or more idlers 308, and a conveyor belt 310. The discharge conveyor 300 may facilitate the removal of crushed material leaving the extrusion body 320. Exemplary conveyors may include at least a portion that is inclined to provide additional back pressure to crushed material exiting the extrusion body 320.

Figure 8:
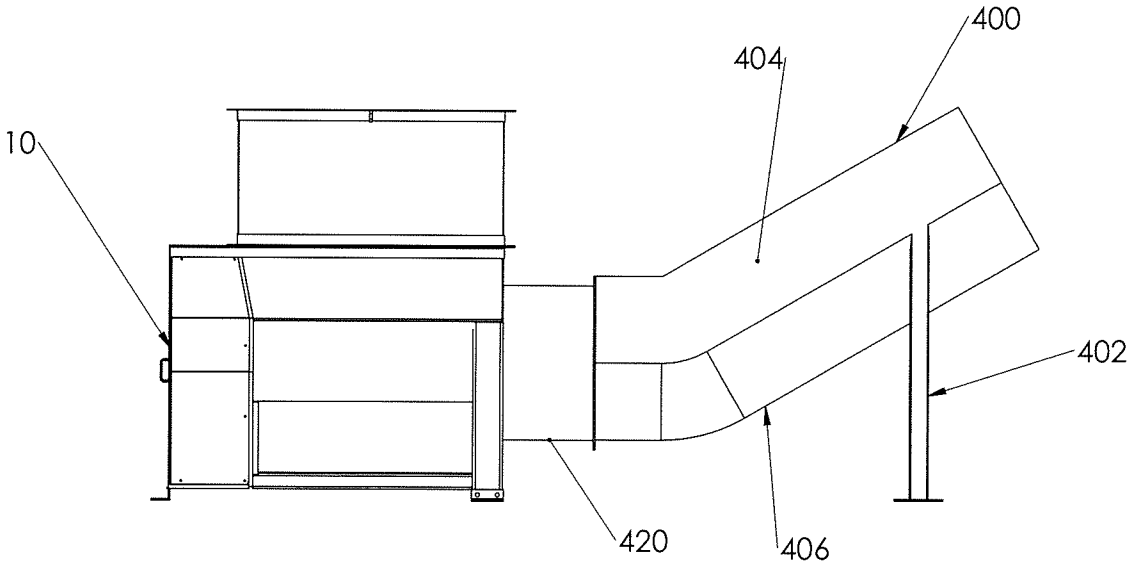
FIG. 8 is an elevated view of an exemplary embodiment of a crusher associated with an exemplary discharge chute.

In another exemplary embodiment, as depicted in FIG. 8, a stand-alone crusher 10 may be associated with a discharge chute 400 by an extrusion body 420. The extrusion body 420 may have any number of cross-sectional geometries, but may be substantially circular in one example. The extrusion body 420 is associated with the distal portion of the compaction chamber 110 to facilitate the removal of the crushed material from therein. The extrusion body 420 may be integral with or associated with the crusher 10.

Exemplary embodiments of the discharge chute 400 may include a frame 402 and a chute body 404. The discharge chute 400 may facilitate the removal of crushed material leaving the extrusion body 420. Exemplary discharge chutes may include at least a portion that is inclined 406 to provide additional back pressure to crushed material exiting the extrusion body 420.

Figure 9:
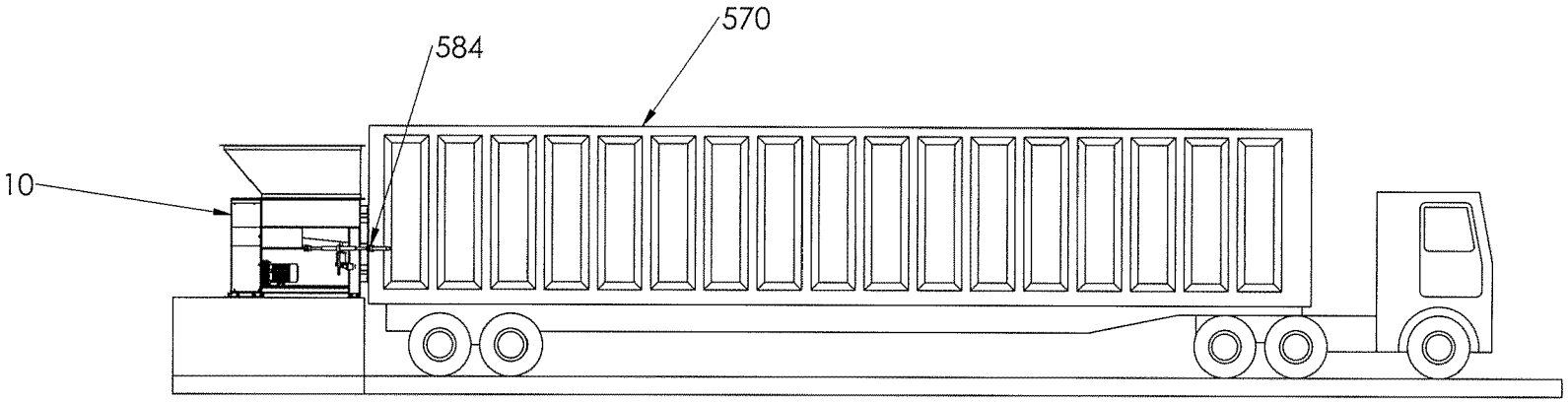
FIG. 9 is an elevated view of an exemplary embodiment of a crusher associated with an exemplary semi trailer.

In another example, as depicted in FIG. 9, an exemplary stand-alone crusher may be associated with a semi-trailer 570. The semi-trailer may function similarly to the exemplary crushed material bin 270 shown in FIG. 6.

In this example, the semi-trailer 570 may include a removable attachment device 584 that facilitates the removable attachment of the semi-trailer 570 with the crusher 10. In one example, the removable attachment device 584 may be a ratchet binder that may be associated with a portion of the crusher 10 and a portion of the semi-trailer 570. In this embodiment, the bin 270 and/or crusher 10 may include one or more attachment bodies that facilitate the utilization of the ratchet binder or equivalent device. Other types of devices that facilitate the removable attachment of the crusher 10 to a semi-trailer 570 may be used.

The semi-trailer 570 may have a number of different geometries that allow suitable operation of the crusher 10. In one example, the semi-trailer 570 is substantially cuboid. Also, in some exemplary embodiments, at least a portion of the bottom inner surface of the material bin may be concave or slanted to facilitate collection of the crushed material at a certain point within the semi-trailer 570. Furthermore, exemplary embodiments of the semi-trailer 570 may include a screening device or include a slotted portion that is associated with one or more drainage apertures that may facilitate the drainage of fluids from the crushed material to remove any undesired fluid, debris, or particulates that may enter the semi-trailer 570 during use. Exemplary embodiments of a drain aperture may allow a drainage hose or other device to be associated with the drainage aperture to facilitate removal of the undesired liquid. Additionally, some exemplary embodiments of the semi-trailer 570 may include drain apertures that facilitate the cleaning or maintenance of the semi-trailer 570.

With reference to FIG. 9, at least a portion of a sidewall of the semi-trailer 570 may be movably attached (e.g., pivotally, hingedly, slidably, removably, or any other suitable type of moveable attachment) thereto to allow access to the crushed material contained therein. In one example, at least a portion of the sidewall may be hingedly attached to another portion of the semi-trailer 570, where a hinge secures one side of the sidewall portion with the semi-trailer 570, and a pin or other securing device may releasably secure the other side of sidewall portion with the semi-trailer 570. Although the previous example uses a hinge to releasably secure the side wall to the semi-trailer 570, other exemplary embodiments may use other securing means (e.g., locks, clamps, screws, etc.) to effectuate a releasable securement. To help prevent material loss, a gasket or similar device (not shown) may be positioned between the engaged portions. In other embodiments, other types of apparatus that allow for access to the material housed within the trailer are appreciated.

In exemplary embodiments, the semi-trailer 570 may facilitate the crushing of material by providing a back pressure against material exiting the compaction chamber during use. When crushed material accumulates within the semi-trailer 570, an exemplary embodiment of the crusher 10 may overcome the force of the piled and crushed material when providing additional crushed material within the interior of the semi-trailer. As more and more material accumulates, the greater the back pressure provided by the crushed material within the trailer to material that is exiting the compaction chamber. As such, in an exemplary embodiment, the material that exits the compaction chamber 110 of the crusher 10 may sustain a desired level of compaction or actually be compacted even further. This may lead to circumstances where baling or other additional procedures are not required, greatly reducing the recycling costs to recyclers. Furthermore, this produces a scenario wherein a restriction mechanism may not be required to obtain desired compaction of materials unlike known compactors.

Although not shown, exemplary embodiments of the crusher 10 may include an electrical junction box (not shown) that may be mounted on the frame 102. However, the electrical junction box may be positioned at other suitable locations associated with the crusher 10, including other enclosures. The electrical junction box may be in electrical association with and facilitate the operation of components that utilize electricity included in exemplary embodiments of the crusher 10.

Exemplary embodiments of the crusher 10 may include an electric motor to turn the screw assembly 130 that is mounted on the frame 16. In one example, the motor is a dual-voltage three phase TEFC motor that is variable speed. However, in other exemplary embodiments, other motors may be used that are able to suitably rotate the screw assembly 130, including motors that are operated by power sources other than electricity. However, an electric motor may be preferred because the electric motor may not emit any toxic emissions, unlike other motors that may be used. In some exemplary embodiments, a gearbox or reducer (not shown) may be in association with the motor to allow a user to vary the rotation speed of the screw assembly 130 during operation of the crusher 10. In one example, a hollow-shaft gearbox or reducer may be used. By including a gearbox or reducer, a smaller motor may be used to provide the required torque to suitably operate the crusher. In exemplary embodiments that include a gearbox or reducer, the gearbox or reducer may be used in association with the proximal end of the screw shaft. However, in other embodiments, the motor and/or gearbox may be in association with other portions of the screw assembly 130 to facilitate rotation thereof. In some examples, a variable frequency drive (VFD) (not shown) may be used to control the rotational speed of the screw assembly 130. In some embodiments, a coupler may facilitate the transfer of rotational movement from the motor to the screw assembly 130. In one example, a tapered shaft coupling may be used, although other types of couplers may be used in other embodiments. The motor and/or associated gearbox may be situated at any suitable portion of the crusher, depending on desired design characteristics, etc.

Some exemplary embodiments of the crusher 10 may include an infeed hopper 190. In exemplary embodiments, at least a portion of the lower surface of the infeed hopper 190 may be mounted to engage at least the upper surface of the compaction chamber 110 by the use of a mounting body that is adapted therefore. In other exemplary embodiments, an infeed hopper 190 may have any suitable association with the compaction chamber 110. Exemplary embodiments of at least a portion of the infeed hopper 190 may be substantially an inverted pyramid in geometry, with at least one opening at the peak end and the base end of the hopper 190. In other embodiments, any number of infeed hopper geometries may be used to facilitate the introduction of material to the compaction chamber 110. In some exemplary embodiments, the infeed hopper 190 may include a cover or similar device (not shown) that may reduce the likelihood of materials flowing back up the hopper during use of the crusher 10.

Exemplary embodiments of the crusher 10 may include an enclosure that covers the motor and/or reducer. In one example, the enclosure may be mounted to the frame 102 or brackets extending from the frame. Exemplary embodiments of the enclosure may include one or more access panels that allow an individual to access the components contained therewithin. The access panels may be positioned wherever it is desired to access the components within the enclosure.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A system for crushing a material, comprising:

a compaction chamber including a proximal inlet portion configured to receive the material and a distal outlet portion configured to allow crushed material to exit; and a cantilevered screw assembly having a shaft with a proximal portion at which it is cantilevered and a distal portion such that the shaft extends between the proximal and distal portions of the compaction chamber, a section of the shaft increasing in diameter in a proximal-to-distal direction such that the system is configured to crush the material between the compaction chamber and the section of the shaft that is increasing in diameter, the shaft further including a flattened portion extending from the section of the shaft that is increasing in diameter and that substantially maintains a maximum diameter of the shaft such that the flattened portion facilitates the crushing of materials to a desired thickness.

2. The system of claim 1 wherein the distal outlet portion has a substantially tubular geometry.

3. The system of claim 1 wherein a maximum diameter of the shaft is reached within the distal outlet portion.

4. The system of claim 1 wherein a distal end of the flattened portion is within the distal outlet portion.

5. The system of claim 1 wherein the compaction chamber comprises a series of longitudinal members secured by at least one securing member along a length of the compaction chamber, wherein the longitudinal members facilitate removal of liquid from the compaction chamber.

6. The system of claim 1 further comprising a crushed material bin associated with the compaction chamber and configured to receive and hold material that has been crushed and exited the compaction chamber.

7. The system of claim 6 wherein the crushed material bin is configured such that crushed material received in the bin may build up and provide back pressure to facilitate compaction of the crushed material in the bin.

8. The system of claim 6 wherein the crushed material bin is integral with the compaction chamber.

9. The system of claim 6 wherein the crushed material bin is a rolloff container that is detachably associated with the compaction chamber.

10. The system of claim 1 further comprising an extrusion body associated with the compaction chamber to facilitate transfer of the crushed material.

11. The system of claim 10 further comprising a discharge chute associated with the extrusion body and configured to further transfer the crushed material.

12. The system of claim 10 further comprising a discharge conveyor associated with the extrusion body and configured to further transfer the crushed material.

13. The system of claim 1 further comprising at least one flow bar situated within at least a portion of an interior face of the compaction chamber to facilitate flow of the material.

14. The system of claim 1 further comprising a drain aperture associated with the compaction chamber.

15. The system of claim 1 wherein the screw assembly further comprises an end flight after the flattened portion and configured to provide thrust to crushed material for further conveyance.

16. The system of claim 1 further comprising a metering member associated with at least a portion of the screw assembly to regulate a volume of material in the compaction chamber.

17. The system of claim 1 wherein the section of the shaft that is increasing in diameter is integral with a remainder of the shaft.

18. The system of claim 1 further comprising a frame such that:

the compaction chamber is mounted to the frame; and the screw assembly is cantilevered to the frame.

19. The system of claim 1 further comprising a flight that extends about the section of the shaft that increases in diameter such that a height of the flight progressively decreases as the flight moves toward the distal portion of the compaction chamber.

20. A system for crushing a material, comprising:

a compaction chamber including a proximal inlet portion configured to receive the material and a distal outlet portion configured to allow crushed material to exit; and a cantilevered screw assembly comprising a shaft with a proximal portion at which it is cantilevered and a distal portion such that the shaft extends between the proximal and distal portions of the compaction chamber, a section of the shaft increasing in diameter in a proximal-to-distal direction, the shaft further comprising a flattened portion after a maximum diameter of the shaft is reached and that substantially maintains the maximum diameter of the shaft;

wherein the system is configured to crush the material between the compaction chamber and the flattened portion of the shaft.

21. The system of claim 20 wherein the distal outlet portion has a substantially tubular geometry.

22. The system of claim 20 wherein the maximum diameter of the shaft is reached within the distal outlet portion.

23. The system of claim 20 wherein a distal end of the flattened portion is within the distal outlet portion.

24. The system of claim 20 wherein the compaction chamber comprises a series of longitudinal members secured by at least one securing member along a length of the compaction chamber, wherein the longitudinal members facilitate removal of liquid from the compaction chamber.

25. The system of claim 20 further comprising a crushed material bin associated with the compaction chamber and configured to receive and hold material that has been crushed and exited the compaction chamber.

26. The system of claim 25 wherein the crushed material bin is configured such that crushed material received in the bin may build up and provide back pressure to facilitate compaction of the crushed material in the bin.

27. The system of claim 25 wherein the crushed material bin is integral with the compaction chamber.

28. The system of claim 25 wherein the crushed material bin is a rolloff container that is detachably associated with the compaction chamber.

29. The system of claim 20 further comprising an extrusion body associated with the compaction chamber to facilitate transfer of the crushed material.

30. The system of claim 29 further comprising a discharge chute associated with the extrusion body and configured to further transfer the crushed material.

31. The system of claim 29 further comprising a discharge conveyor associated with the extrusion body and configured to further transfer the crushed material.

32. The system of claim 20 further comprising at least one flow bar situated within at least a portion of an interior face of the compaction chamber to facilitate flow of the material.

33. The system of claim 20 further comprising a drain aperture associated with the compaction chamber.

34. The system of claim 20 wherein the screw assembly further comprises an end flight after the flattened portion and configured to provide thrust to crushed material for further conveyance.

35. The system of claim 20 further comprising a metering member associated with at least a portion of the screw assembly to regulate a volume of material in the compaction chamber.

36. The system of claim 20 wherein the section of the shaft that is increasing in diameter is integral with a remainder of the shaft.

37. The system of claim 20 further comprising a frame such that:

the compaction chamber is mounted to the frame; and the screw assembly is cantilevered to the frame.

38. The system of claim 20 further comprising a flight that extends about the section of the shaft that increases in diameter such that a height of the flight progressively decreases as the flight moves toward the distal portion of the compaction chamber.

* * * * *